US005230436A

United States Patent [19]

Vaughn

[11] Patent Number: 5,230,436

[45] Date of Patent: Jul. 27, 1993

[54] LIQUID STORAGE TANK WITH FLOATING ROOF STRUCTURE

[75] Inventor: L. Gene Vaughn, Anacortes, Wash.

[73] Assignee: Texaco Inc., White Plains, N.Y.

[21] Appl. No.: 890,202

[22] Filed: May 29, 1992

[51] Int. Cl.[5] ..... B65D 88/40

[52] U.S. Cl. ..... 220/220; 220/224

[58] Field of Search ..... 220/216, 220, 227, 224

[56] References Cited

U.S. PATENT DOCUMENTS

| | | | |
|---|---|---|---|
| Re. 29,270 | 6/1977 | Nelson | 220/220 |
| 2,464,803 | 3/1949 | Goldsby et al. | 220/220 |
| 2,735,574 | 2/1956 | Williams | 220/220 |
| 3,587,911 | 6/1971 | Creith | 220/220 |
| 4,286,726 | 9/1981 | Madsen | 220/220 |

*Primary Examiner*—Stephen P. Garbe
*Assistant Examiner*—Nova Stucker
*Attorney, Agent, or Firm*—James J. O'Loughlin; Robert B. Burns

[57] ABSTRACT

A tank for storing liquids, particularly of the vaporized type. A floating roof on the tank includes a peripheral seal which slideably engages the tank inner wall to maintain a degree of sealing as the roof adjusts in response to variations in the liquid level. A plurality of sleeves to depend downwardly from the roof underside to support the latter when the tank has been emptied and is no longer supported on contained liquid. A column is slidably received in each sleeve and is adjustable to limit downward movement of the roof when in the non-supported mode to facilitate the cleaning of the tank interior.

1 Claim, 1 Drawing Sheet

LIQUID STORAGE TANK WITH FLOATING ROOF STRUCTURE

BACKGROUND OF THE INVENTION

Figure 1:
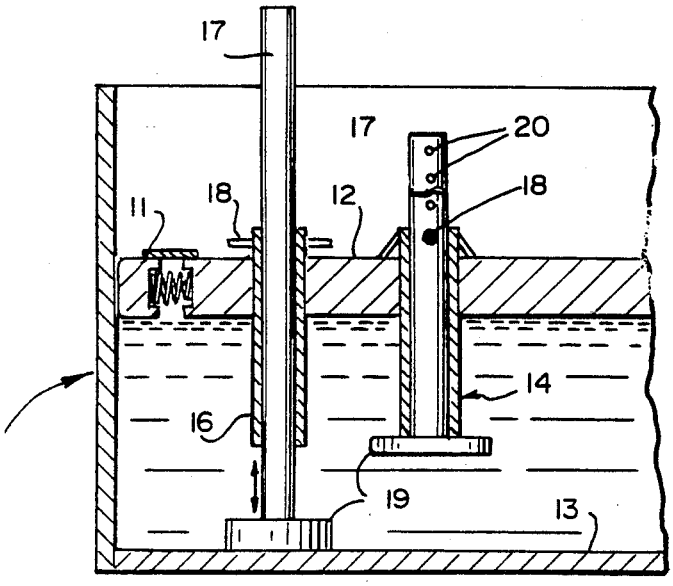
FIG. 1 PRIOR ART

The storage of liquids in tanks characterized by a floating roof structure, is a highly practical way of minimizing liquid vaporization. More specifically, in the instance of storing liquids such as gasoline or the like, use of a roof which is supported by the contained liquid, minimizes the presence of excessive amounts of vapor within the tank, a factor which constitutes a safety hazard due to the volatility of the fumes.

In any liquid holding tank, and in the floating roof type in particular, it is necessary to periodically maintain the integrity of the unit by keeping the sidewalls sufficiently clean. This will assure satisfactory peripheral sealing as the roof moves up and down in response to volumetric changes in the tank's contents. Further, it becomes necessary to periodically clean the tank floor of residue which accumulates over a period of time as solids settle out of the stored liquid.

In any instance, it is usually necessary to empty the tank of stored liquid prior to admitting workmen who will carry out interior cleaning operations.

As the level of the stored liquid drops during an emptying operation, the roof will progressively lower toward the tank floor. Ordinarily, the walls of the tank are clear to permit unimpeded movement of the roof peripheral seal as the roof is adjusted in response to the decreasing level. To avoid interference of the roof with valves, conduits or other hardware in the tank, means is provided to allow the roof to descend to a predetermined level and no lower.

As a matter of practicality, the tank roof is normally provided with adjustable support members which depend downwardly from the roof underside and will contact the tank floor to support the roof when it is at its lowest level. However, when it is desired that the roof be sufficiently high to allow personnel to work in the tank interior, the support members are adjusted by lowering a guided strut and fastening it in place to assure that the desired roof height will be monitored. The lower end of each strut is provided with an enlarged pad or foot that minimizes the amount of compressive stress applied to the tank floor.

The roof-supporting structure, while practical in many respects, does embody several defects. For one thing, due to longitudinal sliding action of the strut within its support sleeve, an annulus will be defined between the two contiguous members. This annulus constitutes a vent opening through which fumes from the tank interior can escape. The unlimited passage of such fumes or gases into the atmosphere can constitute an environmental hazard, which should be avoided.

A further problem which is provoked by escaping gases leaving the tank is the formation of rust or corrosion on parts of the roof support mechanism which are contacted by the fumes as they pass into the atmosphere. It has been found that over a period of time the interior struts can become firmly fixed to the outer guide sleeve, a condition that necessitates a substantial amount of work in breaking the seal to release the interior member.

It can be appreciated that depending on the diameter of the tank, 20 or 30 roof support members may be used, each requiring a considerable investment of time to loosen each stuck member so that the roof can be lowered.

Toward overcoming the stated problem which arise each time a floating roof tank is to be repaired or maintained, there is presently disclosed an improved roof support mechanism that serves two functions. Firstly, it minimizes or precludes the passage of vapors from the contained liquid into the atmosphere. Secondly, it overcomes the problem of the bond formed between the support strut and its guide member due to the corrosive action of the vapors which vent from the tank.

It is, therefore, an objective of the invention to provide a novel and improved liquid storage tank floating roof support.

DRAWINGS

Referring to the drawings, FIG. 1 is a partial segment in cross section illustrating the features of a floating roof tank in accordance with the teaching of the prior art.

Figure 2:
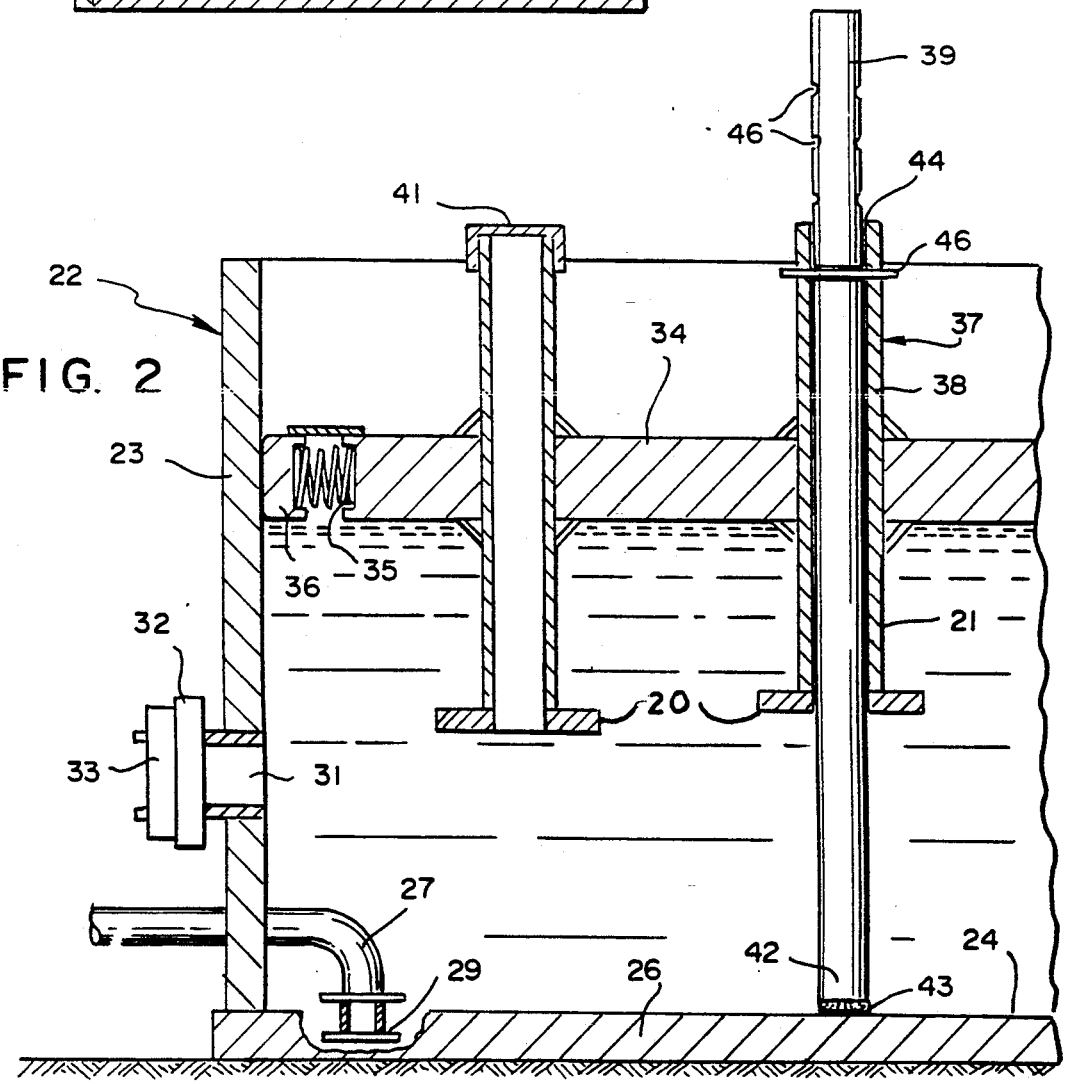

FIG. 2 is similar to FIG. 1 in illustrating the novel and improved tank roof support herein disclosed.

Referring to FIG. 1, the floating roof support means presently utilized in many liquid storage tanks is shown. Here the tank 10 inner wall surface serves as the sliding member for a peripheral seal 11 which is carried on the outer edge of the tank roof 12. The tank floor 13 is normally formed of steel or a similar metal of sufficient thickness to be capable of supporting the roof 12 in its lowered position.

The normal roof support 14 is comprised of a guide sleeve 16, which is firmly fastened to the roof by welding and extends from the tank underside for a distance of approximately four feet. Sleeve 16 functions as a guide and retainer for an elongated strut 17, which is slideably retained within the sleeve at a pin joint 18. A series of longitudinally spaced holes in the strut 17 wall can be aligned with a locking hole 20 in the sleeve to allow strut 17 to be positioned after being raised or lowered to a desired level.

The lower end of strut 17 includes a wide foot or support pad 19 which serves to minimize concentrated stress on floor 13 which would otherwise be exerted by the strut lower end.

Strut 17 for normal application can be raised as shown, to a position in which pad 19 is in substantial abutment with the lower edge of sleeve guide 16. This arrangement does not, however, constitute or suggest; vapor barrier capable of obviating outflow of vapors from the tank.

With each strut 17 adjusted to its lowered or supporting position and locked in place at Joint 18, roof 12 can be allowed to descend with the progressive decrease in the liquid level as the liquid is drained from the tank until all the pads 19 rest on the tank floor 13.

Referring to FIG. 2, the presently disclosed roof support assembly 21 is shown within a cylindrical tank 22 formed by an outer wall 23 and a floor 24 at the lower end which rests on a foundation 26. Tank 22 is normally provided with means for filling and emptying a liquid, which means can constitute in its basic form a conduit 27 which extends through the tank wall, and having a discharge port at the conduit lower end. A filter 29 is normally fixed to the conduit inner end to avoid removing debris and solids from the liquid when the tank is being filled or drained.

An access port 31 in tank wall 23 is comprised of an opening sufficiently large to allow personnel and equipment to pass to and from the tank interior. A closure plate or cover 33 engages a fastening flange 32 of the access port, being fastened by bolts.

Roof 34, which is slidably received within the tank comprises in one form a metallic steel plate structure, made rigid by necessary reinforcing, depending on the diameter of the roof. Roof edge 35 is provided with a peripheral seal member 36, normally spring loaded to maintain tight engagement and avoid unnecessary discharge of vapors from the tank interior.

A roof support mechanism 37 is comprised primarily of an elongated tubular or cylindrical guide sleeve 38 welded to and extending for approximately four feet from the roof under surface, and upwardly a similar distance above the rooftop. Sleeve 38 is positioned vertically to best accommodate a support column 39, which is slidably received in the sleeve center passage to define an annulus or sliding contact there between.

The elongated sleeve lower end is provided with a shoe (20) which extends outwardly from the sleeve (38) lower end to define a relatively broad foundation. The shoe includes a passage or opening in alignment with the sleeve. When tank 22 is partially filled with liquid and roof 34 is resting on the liquid surface, columns 39 will be removed, the respective guidesleeves 38 will be open and are preferably covered with a cap 41 to avoid passage of vapors upwardly into the atmosphere through the annulus 44.

When the tank is to be emptied for cleaning or maintenance purposes, the stored liquid is discharged by way of conduit 27, each sleeve 38 is provided with its elongated column 39 which is slidably inserted through the sleeve upper end. Column 39 lower end 42 is preferably fitted with a plug or similar interior fitting member 43.

The column 39 sidewall is provided with transverse longitudinally spaced openings 46, each of which can be aligned with a corresponding cross passage in the sleeve 38 wall. Operationally, prior to the tank content being fully discharged, each sleeve 38 is provided with a support column 39 by removing the sleeve cover 41 and inserting the column to a desired level.

A locking pin 46 registered in the aligned openings fixes the columns in place. It is appreciated that to avoid excessive stress on the roof structure when the latter is in the lowered position, a sufficient number of support assemblies 37 will be spaced about the roof depending on the roof's diameter.

With all the support columns 39 locked in place, and the liquid permitted to drain through conduit 27, roof 34 will gradually descend at a controlled rate until the lower ends of the respective support columns 39 concurrently engage floor 24. The roof will thus be normally supported six or seven feet above floor 24, to permit ready access of personnel to the tank interior by way of access port 31 such that the tank's interior can be cleaned as required.

It is understood that although modifications and variations of the invention can be made without departing from the spirit and scope thereof, only such limitations should be imposed as are indicated in the appended claims.

I claim:

1. In a cylindrical wall storage tank for containing a liquid, said tank having a floor, a floatable roof supportable by said contained liquid, said roof including a peripheral seal for engaging the cylindrical wall to maintain a fluid-tight sliding seal therewith, and support means associated with said roof including, the improvement in said tank of, at least one cylindrical guidesleeve (38) extending downwardly from said floatable roof;

a shoe (20) depending laterally from said at least one cylindrical guidesleeve's lower end for engaging the tank floor when the level of contained liquid is insufficient to support said floatable roof, said shoe (20) having means forming a passage therethrough to register a support column and, an elongated support column (39) removably positioned in said at least one cylindrical guidesleeve (38), of being sufficient length to extend downward beyond the shoe to engage the tank floor, whereby to sustain the floatable roof a predetermined distance above said floor after the contained liquid has drained from the tank.

* * * * *